US005170562A

United States Patent [19]

Carmichael

[11] Patent Number: 5,170,562

[45] Date of Patent: Dec. 15, 1992

[54] CUTTING/INCISING TOOL

[76] Inventor: Donald D. Carmichael, 2551 Madison St., Hollywood, Fla. 33020

[21] Appl. No.: 821,434

[22] Filed: Jan. 15, 1992

[51] Int. Cl.[5] ..... B26B 29/00

[52] U.S. Cl. ..... 30/294; 30/289

[58] Field of Search ..... 30/294, 286, 289, 290, 30/291, 293, 295; 83/745

[56] References Cited

U.S. PATENT DOCUMENTS

| | | | |
|---|---|---|---|
| 3,874,261 | 4/1975 | Murray | 83/745 |
| 4,179,808 | 12/1979 | Smith | 30/293 |
| 4,195,406 | 4/1980 | Lackey | 30/294 |
| 4,524,662 | 6/1985 | Carley | 83/745 |
| 4,949,462 | 8/1990 | Spencer | 30/294 |
| 4,977,673 | 12/1990 | Altiger | 30/290 |
| 5,083,375 | 1/1992 | Helm, Sr. | 30/293 |

*Primary Examiner*—Frank T. Yost

*Assistant Examiner*—Hwei-Siu Payer

*Attorney, Agent, or Firm*—Schweitzer Cornman & Gross

[57] ABSTRACT

A tool for cutting drip and reglet grooves consists of an elongated frame to which an adjustable cutter blade is mounted. Guide members are mounted to the frame to position the blade with respect to an edge and face of the surface sought to be incised and to maintain the cutter a set distance from the edge. Adjustable handles are provided to allow the tool to be drawn across the surface. The frame may preferably be provided with a series of slots to allow the handles, cutter, and other attachments to be adjustably positioned on the frame. The guide members may preferably include a concave arcuate edge guide and a flat float plate to serve as a surface guide, the two guide elements preferably positioned at opposite ends of the frame.

8 Claims, 3 Drawing Sheets

CUTTING/INCISING TOOL

The present invention relates to a new and improved apparatus and, in particular, to a tool particularly adapted for efficiently incising drip or reglet grooves in construction materials.

BACKGROUND OF THE INVENTION

In construction work when an overhang, such as a ledge, soffit or window header exists, water has a tendency to collect upon the undersurface of the overhang. If such moisture remains for an extended period of time, deterioration of the overhang can result. In addition to collecting on the lower surface, the water can flow back onto the vertical surface of the structure, increasing the likelihood of leaks and, in general, increasing the likelihood of deterioration of the structure due to the effects of the water. Accordingly, drip cuts are provided in the lower surface of the overhang to cause a discontinuity to the horizontal plane, breaking the surface of the sheet of water which would otherwise form and creating a drip path. With the establishment of a drip path, the water drains from the overhang.

In addition to such drip cuts formed on horizontal surfaces, horizontal or vertical grooves, typically for decorative effects, are often placed into stucco or plaster walls. Such grooves are known as reglet cuts. Both drip and reglet cuts require the grooves to be straight and to be to an even, consistent depth along their length.

Current manual methods for cutting in such grooves typically require two persons. A line is marked at the location of the cut. A straightedge is aligned along the line by one worker, while a second worker cuts the groove along the straight edge using an appropriate sharp tool. It is often difficult to maintain alignment along the straight edge and, at the same time, apply appropriate pressure to maintain an even depth.

The alternative to such a method is the inclusion on the construction face of a material to create a groove. A channel piece defining the groove is fastened to the construction frame along the appropriate line, prior to the placing of the stucco or plaster. The plaster or stucco material is then built up around the groove. As the surface material is typically applied in layers, care must be given to cleaning the groove as each layer is built up. In addition, the surfacing material must be applied in a manner to avoid cracks and unevenness about the groove. The use of a paint compatible both for the surface and groove material has also been a problem with such a construction.

It is accordingly the purpose of the present invention to provide a drip/reglet cutting tool which allows the cut to be measured and incised in the same operation.

A further purpose of the present invention is to provide a drip/reglet cutting tool which allows the cut to be made evenly and to a consistent depth.

Yet a further purpose of the present invention is to provide such a tool which may be operated by one person, thereby saving time and labor costs.

Still a further purpose of the present invention is to provide such a tool which is adjustable, may be used with a wide variety of surface materials to be cut, and which is economical to manufacture and operate.

BRIEF DESCRIPTION OF THE INVENTION

In accordance with the above and other features and objects, the present invention comprises a tool having an elongated frame to which an adjustable cutting blade is affixed. The frame is provided with guide means to allow the tool to be positioned and maintained at a constant orientation with respect to an edge of the structure, thus maintaining the cutter at a set distance from the edge, whereby a groove which is straight and parallel thereto may be cut. The tool body is also maintained at a constant height above the surface of the structure, whereby the depth of the groove is maintained at a consistent value.

The tool may be provided with a pair of handles, the handles being positionable to provide a comfortable grip allowing the user to both guide and stabilize the tool during operation. The guide and cutter elements may be adjustable to allow full versatility of operation, while the operating length of the tool may be adjusted.

BRIEF DESCRIPTION OF THE DRAWINGS

A fuller understanding of the present invention and the features and operation thereof will be obtained upon consideration of the following detailed description of a preferred, but nonetheless illustrative, embodiment thereof, when reviewed in connection with the annexed drawings, wherein.

DETAILED DESCRIPTION OF A PREFERRED EMBODIMENT

Figure 1:
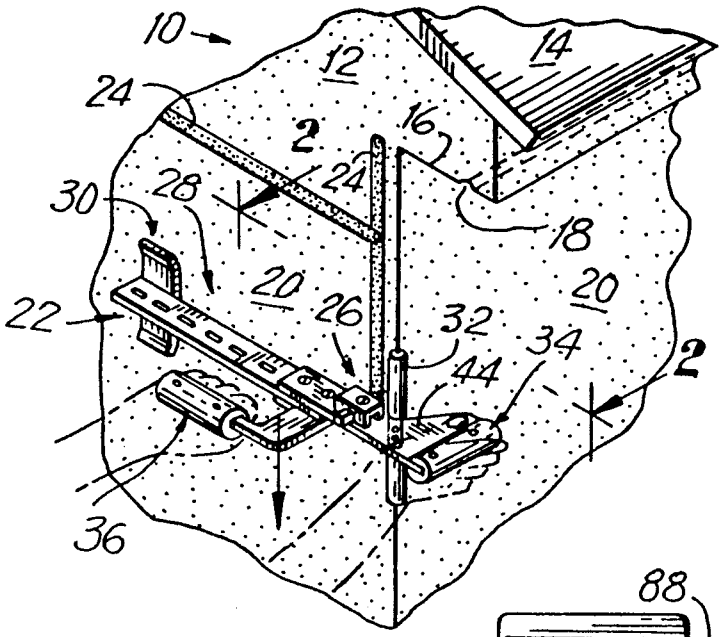
FIG. 1 is a perspective view of the present invention shown in operation.

Referring initially to FIG. 1, a typical building or other structure 10, the surface of which is to be incised, may be of a construction having its exterior surfaces 12 of stucco or plaster. Roof 14 is formed with soffit 16 in which a drip groove 18 is provided to prevent sheeting of accumulated water and its migration and running down a vertical side wall 20. The present invention is embodied in tool 22, adapted to cut both drip grooves 18, as well as other grooves of constant, controlled depth, such as vertically or horizontally-extending reglet grooves 24 on the wall 20. The groove is cut by cutter assembly 26 mounted to frame 28, which is located and supported with respect to the surface into which the groove is to be cut by guide and support elements 30 and 32. A pair of handles 34, 36 allow the operator to grip the tool and draw it along the surface to be cut.

Figure 2:
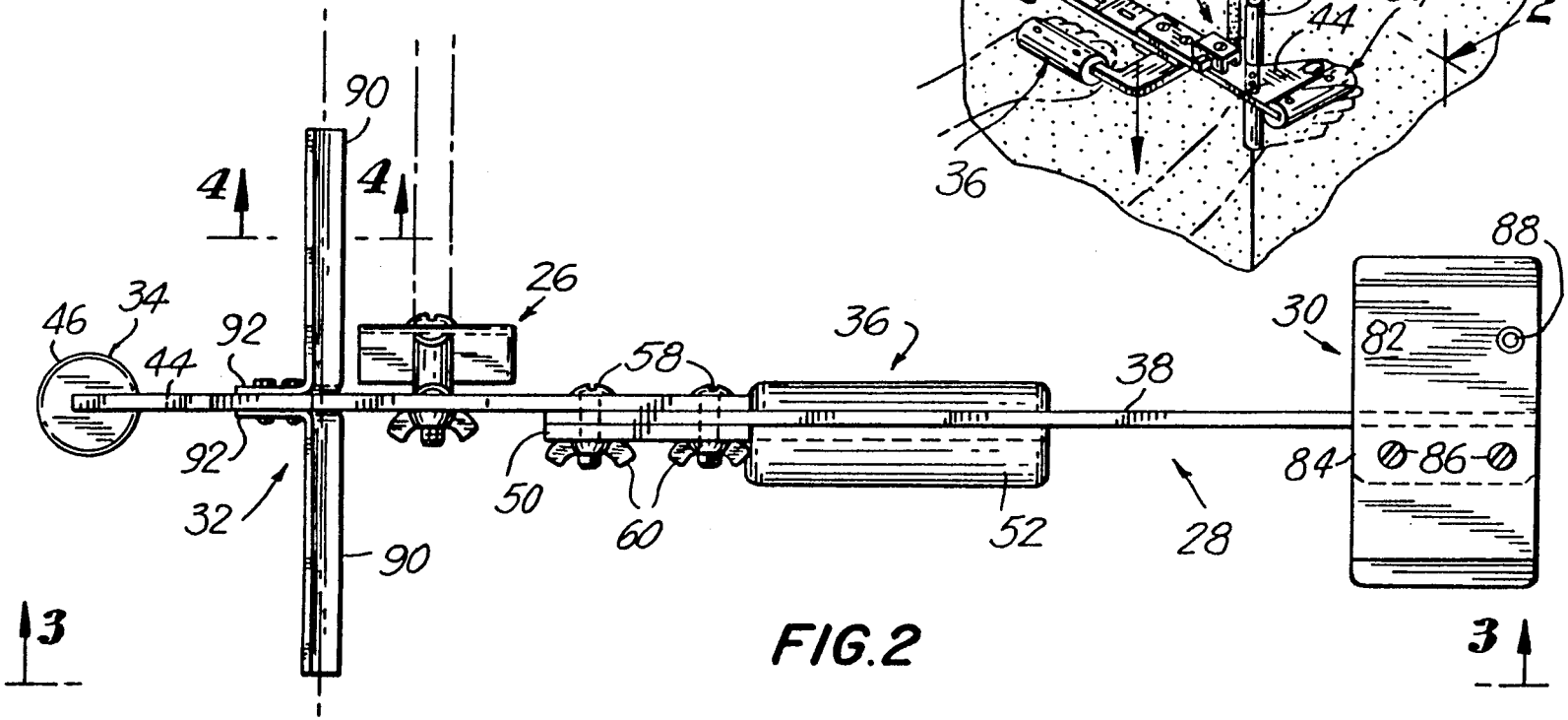
FIG. 2 is a bottom plan view of the tool as seen from direction 2—2 in FIG. 1.
Figures 3, 4, 5:
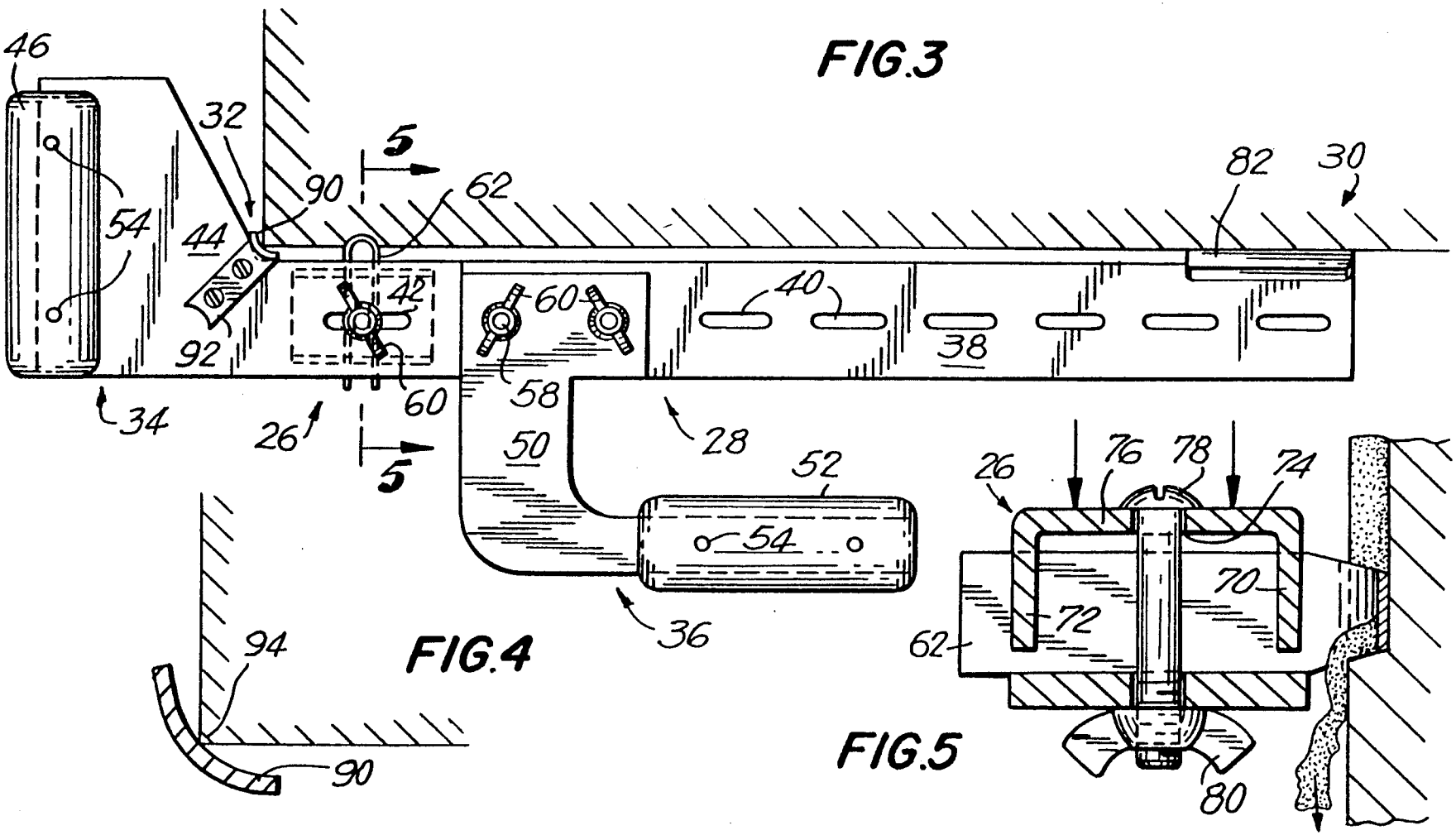
FIG. 3 is a side elevation of the tool in operation take along line 3—3 of FIG. 2.
FIG. 4 is a detail elevation view of the edge guide component of the tool.
FIG. 5 is a detail elevation view in section taken along line 5—5 of FIG. 3 depicting the cutter blade assembly.

Referring next to FIGS. 2 and 3, the frame 28 of the tool may be preferably formed as an elongated plate or bar 38 of an appropriate rigid material, such as aluminum. It is provided with a plurality of spaced, elongated slots 40 along its length to permit various elements to be mounted on the frame as appropriate, as will be discussed herein. The first handle unit 34 may be mounted at the first end of the frame, the handle unit comprising a generally L-shaped arm section 44 and a cylindrical handgrip portion 46 affixed upon the flange in a known manner, such as by rivets 54. The horizontally-extending leg of the arm is provided with a plurality of slots 42 spaced as are the slots 40 on the frame, whereby the handle unit may be connected to the frame by bolts 58 and wingnuts 60. While shown positioned at the first end of the frame, it is to be appreciated that handle unit 34 may be positioned as desired along the length of the frame.

The second handle unit 36 is provided and is adjustably positioned to the frame, and comprises a generally J-shaped mounting arm 50, the distal end thereof being embraced by generally cylindrical handgrip 52. This handgrip may be similarly affixed to the mounting plate by any of a variety of means as known in the art, such as by the use of rivets 54. The proximal end of the mounting arm 50 is provided with a pair of bores 48 (see FIG. 6) positioned to align with a pair of adjacent slots 40 in frame 38, whereby the handle assembly may be positioned as desired along the length of the frame. As shown in the Figures, the same set of bolts 58 and wingnuts 60 may be used to affix both handles 34 and 36 to the frame. Alternatively, the mountings may be spaced from each other.

Figure 8:
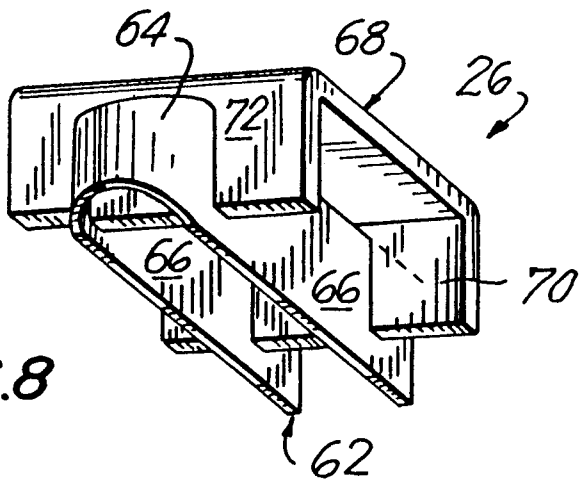
FIG. 8 is a perspective detail view of the blade and blade holder assembly.

Cutting of the groove is performed by cutter assembly 26, further depicted in FIGS. 5 and 8. The cutter assembly 26 includes a blade 62, which may be formed of sheet stock bent into a generally U-shape configuration having a shank portion 66 and a cutter portion 64. The cutter portion may be formed into any desired configuration: curved, square, oval, V, or the like, and may be shaped and sharpened to provide dual cutting action, such that it incises the surface when drawn in either direction.

The shank 66 is supported within a pair of slots in the opposed legs 70, 72 of U-shaped mounting block 68. The positioning of the blade within the block allows the depth of cut to be controlled. The mounting block 68 is provided with a throughbore 74 in its central portion 76, permitting both the blade and block to be mounted to the frame by a bolt and wingnut combination 78, 80 through the bore 74 and an aligned frame slot 40. Depending on the desired positioning of the cutter assembly, the mounting bolt may pass through a slot in the handle arm 44, as best seen in FIG. 2.

The tool is positioned and supported with respect to the surface to be incised by support 30 operating in conjunction with edge guide support 32. As seen in FIGS. 2 and 3, support 30 may preferably be in the form of a flat, generally rectangular float plate 82, having a smooth top surface with tapered edges which allows it to pass smoothly along the surface of the construction. It is mounted perpendicular to the frame 38 by a right angle bracket 84 which may be formed as part of the frame and which carries a pair of threaded bores through its horizontally-extending surface. A pair of bolts 86 are threaded into the bores through aligned smooth bores in the float plate 82, the upper ends of which are countersunk to maintain its smooth upper surface. An additional countersunk bore 88 may be provided in the float plate along a line perpendicular to the bores 86 to allow the plate to be alternatively positioned with its longer side parallel to the length of the frame 38 when a narrower width plate is required. Alternatively, other brackets and plates may be installed along the frame. The bracket in such a case may be affixed to the frame by bolts and wingnuts. The edges and corners of such plate may be rounded and beveled to enhance the ability of the plate to slide over the plaster or stucco surfaces.

The edge guide 32, which positions and maintains the tool in perpendicular alignment to an edge of the construction as seen in FIG. 1, thus allowing a cut parallel to the edge, comprises a pair of elongated, generally "c" shaped channel member 90 each mounted perpendicular to the length of the frame by a bracket 92 affixed to handle arm 44. As depicted in the Figures, each channel member is mounted to an opposite side of the frame. Alternatively, one channel member, either on one side alone or extending outwardly from both sides of the frame, can be employed.

The length of the channel members is such that they provide a sufficient bearing surface against the construction edge or corner 94 to minimize rocking or misalignment of the tool with respect to the edge. As may be seen in FIG. 4, the construction of the channel member is such that it provides one point contact with the construction corner 94 such that the degree of contact is minimized to avoid marring of the wall surfaces and to limit drag while providing continued alignment of the tool.

Figure 6:
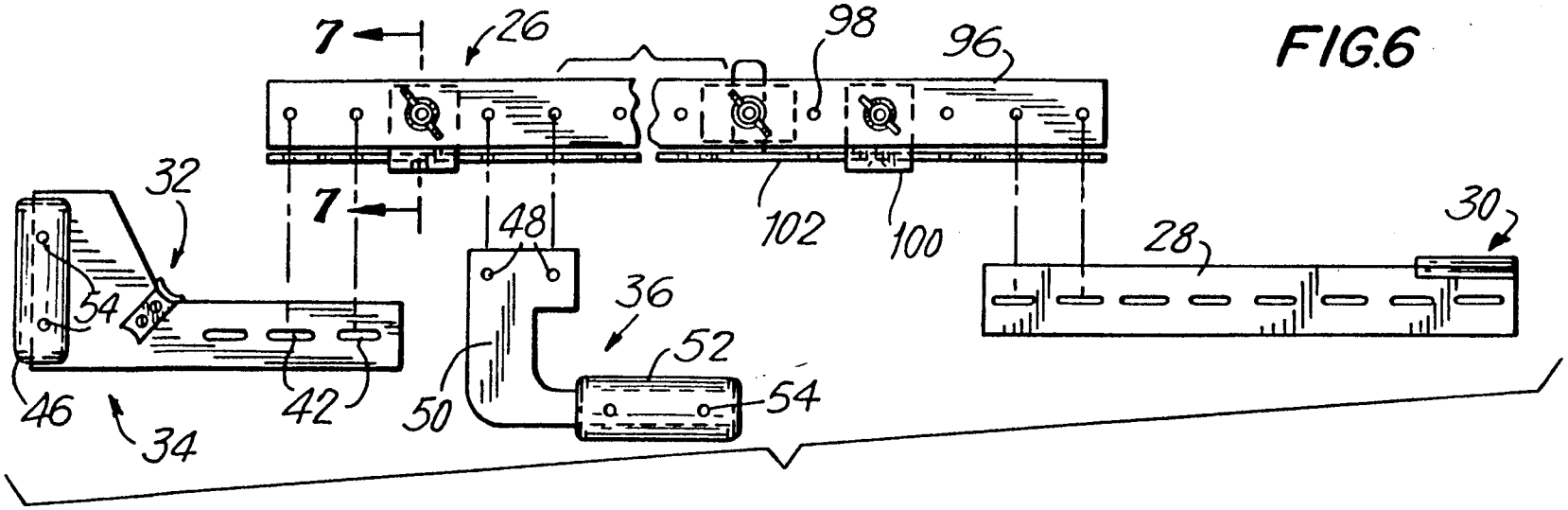
FIG. 6 is an exploded elevation view of the tool whereby the main components are indicated.
Figure 7:
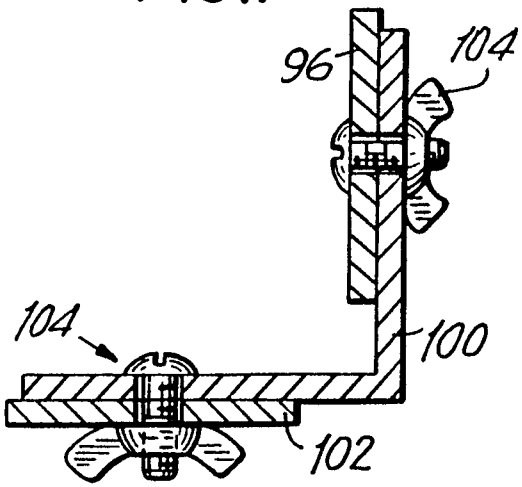
FIG. 7 is a detail elevation view in section taken along line 7—7 of FIG. 6 depicting the interconnection of elements.

As shown in FIGS. 6 and 7, the frame may be provided with an extension piece 96 which allows the overall length of the tool to be extended to accommodate drips or reglets spaced a large distance from an edge. The extension piece 96 is of similar construction to that of the frame; is of a plate configuration, and is similarly provided with a plurality of spaced, circular bores 98 being spaced to align by means of bolts and wingnuts with the slots 42 in the other tool elements and to allow attachment thereof. In order to provide additional rigidity for the tool when the extension is utilized, right angle brackets 100, mountable to the extension piece through its bores 98, supports a second extension plate 102 below and perpendicular to the piece 96. Because the second plate is perpendicular to the extension piece 96 and frame 28, it prevents flexure of the extension piece and thus rigidifies the tool. The right angle brackets 100 may be mounted to the extension piece 96 and to the second extension plate 102 by bolt-wingnut combination 104.

With the cutter assembly 26 mounted to the tool and depth of cut adjusted and the handle units affixed as desired, the tool is brought to bear against the surface to be incised, as best seen in FIG. 3. The edge guide 32 engages the corner 94 of the construction, the concave shape of the channel member maintaining contact with the corner of the structure to minimize drag and provide alignment. The distal end of the tool is placed in contact with the surface through the float plate 82.

It is to be recognized that the point of contact of the channel member 90 with the corner 94 and the upper surface of the float plate 82 are in the same plane, such that the tool sits parallel to the surface to be incised. The tool is then drawn along the surface parallel to the referenced edge, the guide 32 being maintained in contact with the edge, as seen in FIG. 1, whereby the cutter blade 64 provides the desired incision. Preferably, the tool is utilized from the time the surface to be incised has reached the plastic stage up to approximately one hour later. The drip or reglet is thus produced quickly and economically. If desired, additional cutters may be mounted to the frame to allow multiple grooves to be cut in a single pass.

I claim:

1. A drip/reglet cutting tool for incising a surface of a structure, comprising an elongated frame in the form of a bar having opposed proximal and distal ends; at least one reglet/drip cutter blade adjustably mounted to and projecting downwardly from said frame such that the cut of said blade is along a line perpendicular to the length of said bar, said cutter being repositionable along the length of said frame; a first handle mounted to the proximal end of said frame; a second handle mounted to said frame spaced from said first handle and extending perpendicularly to said first handle; first edge guide means mounted to said frame at said proximal end and second surface guide means mounted to said frame at said distal end for supporting said tool upon the surface to be incised, said first and second guide means being adapted and dimensioned to maintain said frame parallel to the surface, whereby the depth of cut for said cutter is constant irrespective of the position of said cutter along the length of said frame.

2. The tool of claim 1, wherein said edge guide is affixed to said first handle.

3. The tool of claim 2, wherein said edge guide is in the form of a concave arcuate plate projecting perpendicular to the length of said frame.

4. The tool of claim 1, wherein said surface guide is in the form of a plate mounted to the distal end of said frame for single point contact with the edge.

5. The tool of claim 1, wherein said frame comprises at least two elongated frame elements, said frame elements being joinable in a generally end-to-end relationship.

6. The tool of claim 5 further comprising stiffener means adapted to be mounted to at least one of said frame elements.

7. The tool of claim 1, wherein said mounting means comprise a series of slots in said frame, co-aligned bores in said handle means and cutter, and means to join said handle means and cutter to said frame through aligned slots and bores.

8. The tool of claim 7, wherein said joining means comprise nuts and bolts.

* * * * *